United States Patent [19]

Jacobs et al.

[11] 4,420,708

[45] Dec. 13, 1983

[54] HIGH-PRESSURE SODIUM VAPOR DISCHARGE LAMP

[75] Inventors: Cornelis A. J. Jacobs; Peter A. W. Tielemans, both of Eindhoven, Netherlands

[73] Assignee: U.S. Philips Corporation, New York, N.Y.

[21] Appl. No.: 182,192

[22] Filed: Aug. 28, 1980

Related U.S. Application Data

[63] Continuation of Ser. No. 960,419, Nov. 13, 1978, abandoned.

[30] Foreign Application Priority Data

Dec. 2, 1977 [NL] Netherlands ..... 7713348

[51] Int. Cl.[3] ..... H01J 61/073

[52] U.S. Cl. ..... 313/628; 313/630

[58] Field of Search ..... 313/213, 211

[56] References Cited

U.S. PATENT DOCUMENTS 3,708,710 1/1973 Smyser et al. ..... 313/184 X 4,052,634 10/1977 DeKok ..... 313/184

4,152,620 5/1979 Bhalla ..... 313/213

FOREIGN PATENT DOCUMENTS 728769 2/1966 Canada ..... 313/213

*Primary Examiner*—Robert Segal

*Attorney, Agent, or Firm*—Robert S. Smith

[57] ABSTRACT

A high-pressure sodium vapor discharge lamp contains an electron-emitting material consisting of alkaline earth metals bound to oxygen and tungsten bound to oxygen. It has been found that such lamps of less than 400 W which have either a high Hg/Na ratio or use neon/argon as a starter gas fail prematurely when the alkaline earth metals and tungsten in the electron-emitting material are present in stoichiometric quantities.

The free ends of electrodes of lamps according to the invention are wound with tungsten wire. Electron-emitting material comprising carium, strontium and calcium bound to oxygen and tungsten bound to oxygen is disposed in the cavities formed between the tungsten wire turns. The molar ration of the total barium, strontium and calcium bound to oxygen to the tungsten bound to oxygen is between 8 and 50.

2 Claims, 2 Drawing Figures

HIGH-PRESSURE SODIUM VAPOR DISCHARGE LAMP

This is a continuation of application Ser. No. 960,419, filed Nov. 13, 1978, now abandoned.

The invention relates to a high-pressure sodium vapour discharge lamp having a hermetically sealed tubular ceramic discharge vessel containing sodium, mercury and a rare gas, and lead-through conductors which extend through the ends of the discharge vessel to respective electrodes disposed in the discharge vessel and wound at their free ends with tungsten wire, the cavities formed between the tungsten wire turns being filled with an electron-emitting material containing alkaline earth metals bound to oxygen and tungsten bound to oxygen. The discharge vessel in such lamps consists of an oxide which can withstand high temperatures, usually polycrystalline aluminium oxide or monocrystalline aluminium oxide (sapphire).

High-pressure discharge lamps including those mentioned in the preamble, are disclosed in U.S. Pat. No. 3,708,710. The emitter used in said lamps contains 43–54 mol% BaO, 20–30 mol% CaO and 21–27 mol% $WO_3$. Electron-emitting materials situated within said range are to be preferred, wherein BaO, CaO and $WO_3$ are in the relation 1.9:1:1–2.1:1:1 expressed in gmol, in particular $Ba_2CaWO_6$, where $BaO:CaO:WO_3=2:1:1$. Calculated on the ratio of the total amount of alkaline earth oxides in gmol ($\Sigma MO$) and tungsten trioxide in gmol ($WO_3$), these known electron-emitting materials have compositions defined by $2.7 \leqq \Sigma MO/WO_3 \leqq 3.7$, preferably $2.9 \leqq \Sigma MO/WO_3 \leqq 3.1$ and in particular $\Sigma MO/WO_3=3$.

It has been found that in some types of high-pressure sodium vapor lamps having such an electron-emitting material which comprises alkaline earth metal oxides and tungsten trioxide in a substantially stoichiometric ratio, the lamp voltage increases as the operating life of the lamp increases, as a result of which the lamp extinguishes after a relatively short period of operation. This occurs in particular when using inter alia neon and argon mixtures as a starting gas and also when using high mercury:sodium ratios, for example mercury:sodium ratios of more than 4:1 (wt/wt). This phenomenon also increases as the power of a lamp lies farther below 400 W and if the lamp has two or three of these features.

The lamps which fail because of an increase in the lamp voltage had a considerably blackened discharge vessel.

It is the object of the invention to provide high-pressure sodium vapor discharge lamps of the kind mentioned in the preamble which have a considerably longer life than the known lamps.

The lamp according to the invention is characterized in that the electron-emitting material comprises barium, strontium and calcium as alkaline earth metals bound to oxygen and that the molar ratio of the total quantity of said alkaline earth metals bound to oxygen to the tungsten bound to oxygen is between 8 and 50.

It is remarkable that with these lamps, the electron-emitting materials of which comprise alkaline earth metals bound to oxygen and tungsten bound to oxygen in a ratio which is a few times larger than the stoichiometric ratio ($\Sigma MO/WO_3=3$) lives are achieved which are a few times longer than those of lamps having electron-emitting materials consisting of a stoichiometric composition of alkaline earth metals bound to oxygen and tungsten bound to oxygen.

This is the more remarkable since the said U.S. Pat. No. 3,708,710 indicates that emitters in which the ratio $(BaO+CaO)/WO_3$ exceeds 3.7 have too high an evaporation ratio.

Although it has been found desirable, with a view to preventing a large increase in the lamp voltage, that the electron-emitting material should contain a relatively small amount of tungsten bound to oxygen, this component of the electron-emitting material has a favorable effect on the adhesion of the electron-emitting material to the electrode. The molar ratio of the total amount of the alkaline earth metals bound to oxygen to the tungsten bound to oxygen is preferably between 8 and 35.

The invention is based on the recognition of the fact that the rise of the arc voltage is the result of the disappearance of sodium from the gas filling. In fact, sodium can react with tungstate originating from the electrode and deposited on the wall of the discharge vessel, and the wall material to form a stable compound. Furthermore, the invention is based on the recognition of the fact that the quantity of tungstenate deposited on the wall of the discharge vessel can be considerably reduced by reducing the amount of tungsten bound to oxygen in the electron-emitting material.

In a preferred embodiment the molar quantity of barium and strontium bound to oxygen in the emitter is at least 1.5 times as large as the molar ratio of calcium bound to oxygen in the emitter.

The electron-emitting material may be applied on the electrodes in several manners.

The electrodes may be dipped in a suspension of the electron-emitting material in, for example, methyl alcohol or butyl acetate to which a binder, for example nitrocellulose, may have been added. After evaporation of the suspending agent, excess electron-emitting material is removed from the electrode.

The electron-emitting material may be prepared on the electrode. In that case the electrode is provided with a suspension of alkaline earth metal peroxides, hydroxides, carbonates, formates or other compounds which form oxides upon heating, or with a suspension of one or more alkaline earth metal oxides together with one or more alkaline earth metal compounds which form oxides upon heating. After evaporating the suspending agent, an excess of material can easily be removed from the electrode. The electrodes are then heated so as to convert the alkaline earth compounds into oxides. if oxidizing gases are released, for example carbon dioxide when carbonates are used, the tungsten wire turns of the electrode are oxidised so that oxidized tungsten is deposited on the emitter material. However, the suspension used may already contain tungsten oxide or a tungstate.

By heating the electrodes after drying, a good adhesion of the emitter to the electrode is obtained and salts and hydroxides of the above-mentioned alkaline earth metal compounds present are converted into oxides. In general, heating is carried out for from ten to a few tens of minutes at 850° to 1350° C.

Some embodiments of lamps according to the invention will now be described with reference to the following Examples and to the drawing, in which.

Figure 1:
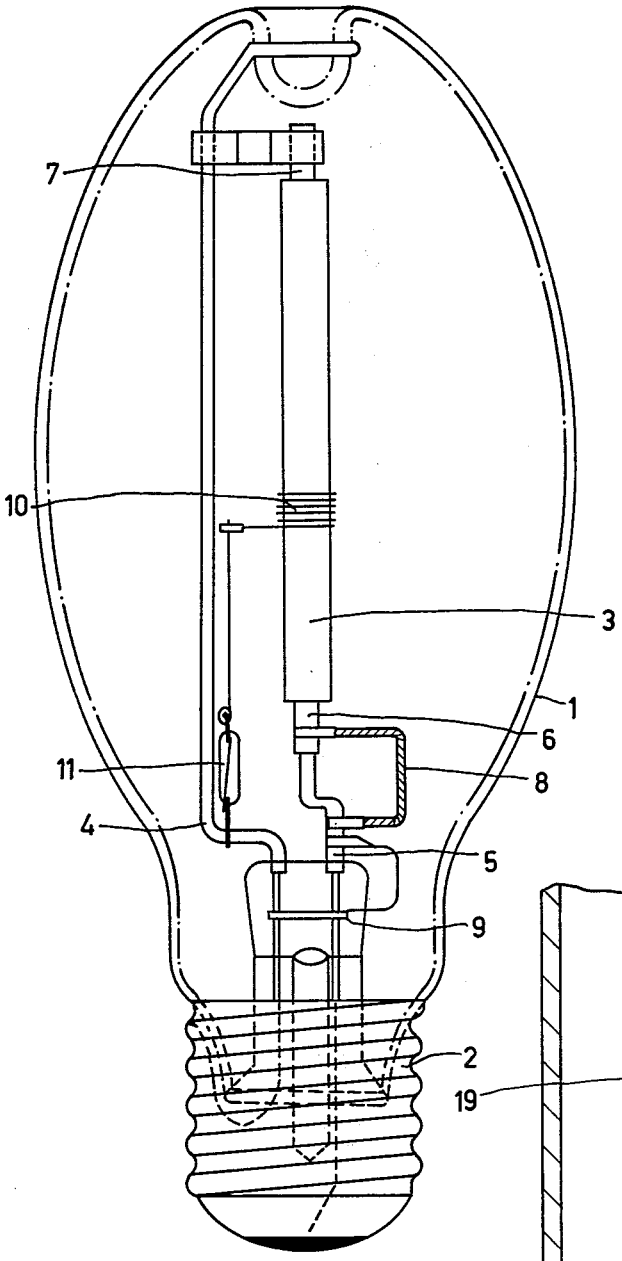
FIG. 1 is a side elevation of a high-pressure sodium vapor discharge lamp.

Referring now to FIG. 1 an aluminium oxide discharge vessel 3 is arranged between current supply conductors 4 and 5 in a glass envelope 1 which has a lamp cap 2.

Niobium sleeves 6 and 7 conduct the current through the wall of the discharge vessel 3 to electrodes (not shown in FIG. 1). Current supply conductor 5 extends into the open end of the niobium sleeve 6 with a small amount of play. A good electrical contact between the two is ensured by stranded wire 8.

A vacuum prevails inside the envelope 1 and is maintained by a barium getter evaporated from ring 9.

A wire 10 is wound around the discharge vessel 3 and is connected to the current supply conductor 4 via a bimetal switch 11. The wire 10 forms an auxiliary electrode which helps to promote ignition of the lamp. As soon as the switch 11 has become warm due to the operation of the lamp, the electrical connection to the wire 10 is interrupted.

Figure 2:
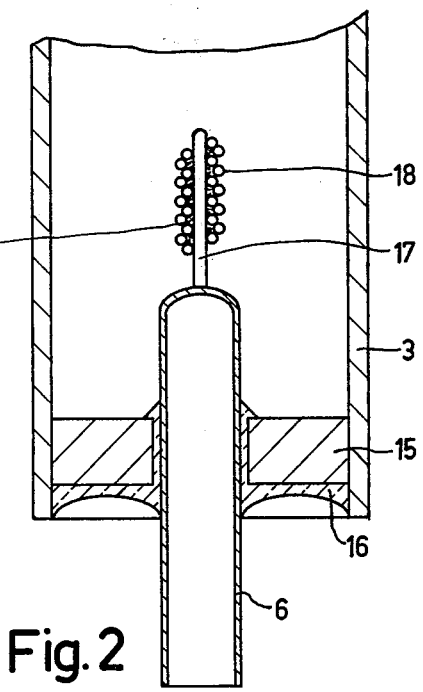
FIG. 2 is a longitudinal sectional view through one end of a discharge vessel of a high-pressure sodium vapor discharge lamp.

Referring now to FIG. 2, the discharge vessel 3 is sealed at its end by means of an alumina ring 15. A niobium sleeve 6 extends through the ring and is sealed thereto by means of a fusible bonding material 16. A tungsten electrode 17 on which a tungsten wire 18 is wound is welded to the sleeve 6. Electron-emitting material 19 is disposed in the cavities formed between the turns of wire 18.

EXAMPLES

A lamp contained a discharge vessel having an inside diameter of 7.8 mm and an outside length of 103 mm. The distance between the tips of the electrodes was 78 mm. 10 mg of electron-emitting material were provided on each of the electrodes in the cavities of the wire turns. The discharge vessel contained 35 mg of sodium amalgam containing 89% by weight of mercury and 20 Torr at room temperature of a starting gas consisting of 99 volumes of neon and 1 volume of argon. During operation, the lamp consumed a power of 360 W.

A number of lamps having the above-described discharge vessels and containing electron-emitting materials of different compositions were life-tested using a repetitive cycle of 5.5 hours on, 0.5 hours off. It was found that the lamps tested according to this cycle reached end of life sooner than when a cycle of 0.5 hours on, 0.5 hours off was used or when the lamps were operated continuously. The first-mentioned cycle was therefore used in the following tests.

Test results are given in Table I for lamps using various electron-emitting material compositions and are compared with the results of identical lamps having $Ba_2CaWO_6$ as an emitter.

TABLE I

| Example | electron-emitting material Σ $MO/WO_3$ | Ba/Sr/Ca (mol) | $\Delta V_{la}$ 2000h | 3000h | 5000h | | lm/W* |
|---|---|---|---|---|---|---|---|
| 1 | 9.5 | 35.6/31.3/33.0 | +6 | +10 | +10 | | 98 |
| 2 | | | −2 | +2 | +6 | | 94 |
| 3 | 17 | 34/31.8/34.1 | +8 | +18 | +11 | | 82 |
| 4 | | | +11 | +10 | +23 | | 93 |
| 5 | 8.5 | 30.2/29.3/31.5 | +8 | +2 | +12 | 7000h + 24 | 92 |
| 6 | | | −1 | −1 | +7 | | 89 |
| 7 | 15 | 39.4/28.7/31.8 | +3 | 0 | +2 | 7000h + 6 | 88 |
| 8 | | | +7 | +6 | +19 | 6100h+ | 88 |
| A | $Ba_2CaWO_6$ | | +26 | +31 | | | 90 |
| B | | | +32 | +<3000h | | | 92 |

*lm/W measured at the last instant at which $\Delta V_{la}$ was measured.
$\Delta V_{la}$: variation of the lamp voltage with respect to the lamp voltage after 100 hours. The electron-emitting material composition is expressed as a molar ratio.

Other examples of electron-emitting compositions are given in Table II.

TABLE II

| Σ $MO/WO_3$ mol/mol | Ba/Sr/Ca (mol) |
|---|---|
| 14 | 30.6/32.4/36.9 |
| 30 | 32.5/31.4/36.1 |
| 8.1 | 32.6/29.6/37.8 |
| 9.1 | 33.0/29.0/38.0 |
| 27 | 38.5/27.9/33.5 |

What is claimed is:

1. A high-pressure sodium vapor discharge lamp which comprises: a hermetically sealed tubular ceramic discharge vessel containing sodium, mercury and a rare gas, at least first and second lead-through conductors extending through said discharge vessel, at least first and second electrodes disposed in said discharge vessel which are respectively connected to said first and second lead-through conductors, said electrodes extending into said vessel and having a plurality turns of tungsten wire disposed around the end thereof extending into said vessel, the space intermediate said turns being filled with an electron-emitting material substantially consisting of alkaline earth metals bound to oxygen and tungsten bound to oxygen, said electron-emitting material comprising barium, strontium and calcium as alkaline earth metals bound to oxygen and that the molar ratio of the total quantity of said alkaline earth metals bound to oxygen to the tungsten bound to oxygen is between 8 and 50.

2. A high-pressure sodium vapor discharge lamp as claimed in claim 1, wherein the molar ratio of the total quantity of the alkaline earth metals bound to oxygen to the tungsten bound to oxygen is between 8 and 35.

* * * * *